United States Patent [19]

Stewart et al.

[11] 3,936,905

[45] Feb. 10, 1976

[54] VACUUM CLEANER SUCTION TOOL

[75] Inventors: Bruce E. Stewart, St. Paul, Minn.; Keith E. Carr, Stevensville, Mich.

[73] Assignee: Whirlpool Corporation, Benton Harbor, Mich.

[22] Filed: June 3, 1974

[21] Appl. No.: 475,971

[52] U.S. Cl. ..... 15/416; 15/354

[51] Int. Cl.[2] ..... A47L 9/00

[58] Field of Search ..... 15/327 R, 331, 354, 416, 15/418, 323, 339

[56] References Cited

UNITED STATES PATENTS

| | | | |
|---|---|---|---|
| 1,782,882 | 11/1930 | Rippey | 15/416 X |
| 2,296,462 | 9/1946 | Betts | 15/416 X |
| 2,348,861 | 5/1944 | Smellie | 15/416 X |
| 2,953,808 | 9/1960 | Carmack | 15/416 X |
| 3,205,528 | 9/1965 | Fromknecht | 15/416 |
| 3,253,294 | 5/1966 | Waters | 15/323 |
| 3,262,147 | 7/1966 | Waters et al. | 15/354 |
| 3,633,239 | 1/1972 | Meyerhoefer | 15/339 X |
| 3,683,448 | 8/1972 | Lagerstrom et al. | 15/354 |

*Primary Examiner*—Harvey C. Hornsby
*Assistant Examiner*—C. K. Moore
*Attorney, Agent, or Firm*—Wegner, Stellman, McCord, Wiles & Wood

[57] ABSTRACT

A suction tool for use in a vacuum cleaner including a nozzle defining a suction inlet including a mid-portion and an edge portion and structure for selective blocking of air flow through the mid-portion to provide selectively high suction force at the edge portion.

13 Claims, 4 Drawing Figures

Fig. 1
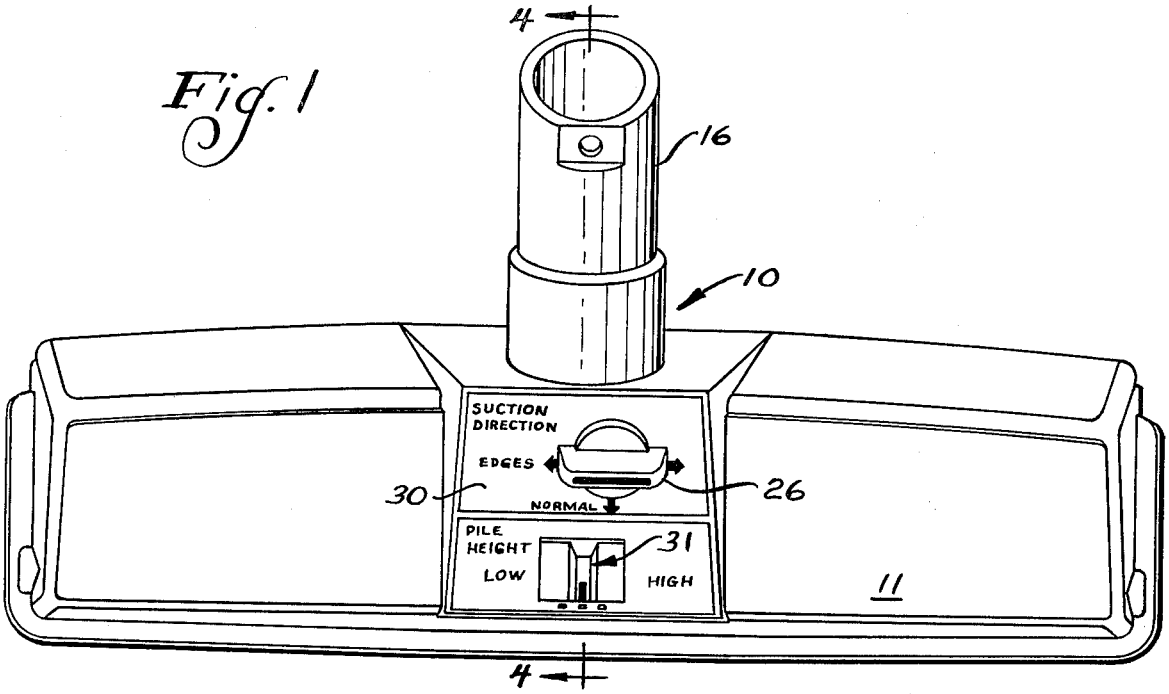
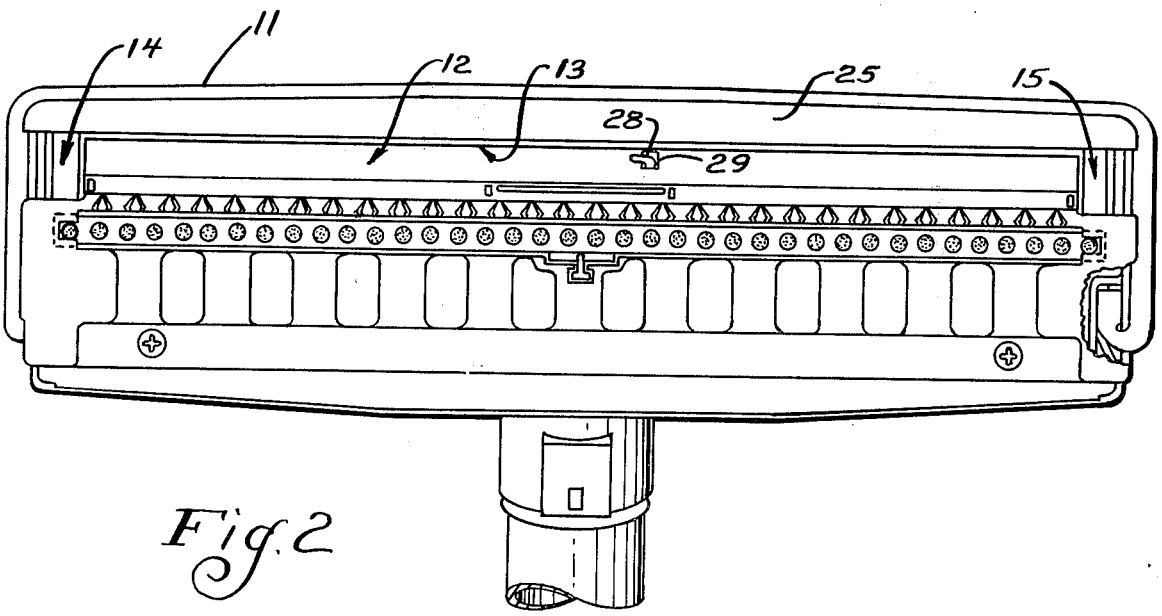
Fig. 2

VACUUM CLEANER SUCTION TOOL

BACKGROUND OF THE INVENTION

1. Field of the Invention

This invention relates to vacuum cleaners, and in particular to suction tools for use in vacuum cleaners.

2. Description of the Prior Art

In one conventional form of vacuum cleaner, a nozzle is provided at the end of a hollow tube, or wand, for applying suction to the surface to be cleaned and permitting dirt loosened from the surface to be sucked in by a stream of air drawn through the nozzle and tube to the dirt collecting receptacle of the vacuum cleaner. The conventional suction nozzle of this type is transversely elongated with the tube extending from the mid-portion thereof. Thus, in the conventional nozzle arrangement, maximum suction is applied at the mid-portion of the nozzle.

One of the deficiencies of the conventional nozzle is its inability to efficiently suck dirt at the opposite ends of the nozzle. This presents a vexatious problem where the unit is being utilized to clean a floor surface adjacent a wall or other upright obstruction. Thus, conventionally, resort is had to bringing the nozzle to adjacent the wall with the direction of elongation thereof parallel to the wall surface requiring substantial repeated manipulation of the vacuum cleaner to effect the desired cleaning of the floor surface adjacent the wall. Such repeated manipulation presents the further problem of potential damage to the wall surfaces as the nozzle must be brought directly up to the wall in effectively cleaning the entire floor surface edge.

A number of different suction nozzle devices have been developed in an attempt to solve this vexatious problem. Thus, as shown in U.S. Pat. No. 1,782,882 of S. H. Rippey, the nozzle is provided with means defining conduits extending to the opposite ends of the nozzle with the flow of air through the conduits being selectively blocked by a manipulatable valve and with the center portion of the nozzle remaining open at all times.

In the subsequent U.S. Pat. No. 1,895,584 of D. B. Replogle, an air cleaning tool is provided with an end closure means which is movable as a result of a downward pressure on the nozzle adjacent the side wheels to provide a controlled flow of air through the end openings. The wheels in the Replogle structure are disposed outwardly of the opposite ends of the nozzle, thereby preventing disposition of either nozzle end directly at a wall.

In U.S. Pat. No. 2,555,979 of G. E. Lofgren, a suction nozzle is shown having a valve for concentrating air flow at the end of the nozzle by varying the amount of closure of the mid-portion of the nozzle. At no time is the entire nozzle open to the tube.

In L. A. Wolf U.S. Pat. No. 3,550,183, a vacuum cleaner cleaning tool is shown having passages leading to the front corners of the nozzle. No means is provided for selectively controlling the relative air flow between the different portions of the nozzle inlet opening.

SUMMARY OF THE INVENTION

The present invention comprehends an improved vacuum cleaner suction tool having means for providing substantially the entire air flow through the nozzle selectively at the end of the nozzle when it is desired to use the nozzle for cleaning the edge of the floor surface adjacent a wall or similar upright obstruction.

More specifically, the invention comprehends such a suction tool including a nozzle defining a suction inlet opening including a mid-portion and an edge portion, a suction outlet opening, and a flow passage for conducting dirt laden air drawn through the suction inlet opening mid-portion and edge portion to the outlet opening, and means for selectively blocking air flow through the suction inlet opening mid-portion to provide selectively high suction force at the suction inlet edge portion or causing said mid-portion to be substantially unrestricted.

In the illustrated embodiment, the nozzle defines an upwardly facing front wall portion and the means for selectively blocking the air flow includes an adjusting control valve having a manipulating portion overlying the front wall.

The air flow blocking means may include a mounting portion and a valve integral with the mounting portion, the mounting portion further defining brush carrying means.

In the illustrated suction tool, means are provided for adjusting the nozzle for use with different pile height carpeting including an adjusting control member disposed adjacent the air flow blocking means adjusting control member.

Thus, the vacuum cleaner of the present invention is extremely simple and economical of construction while yet providing the highly desirable features discussed above.

BRIEF DESCRIPTION OF THE DRAWING

Other features and advantages of the invention will be apparent from the following description taken in connection with the accompanying drawing wherein:

FIG. 1 is a top plan view of a vacuum cleaner suction tool embodying the invention;

FIG. 2 is a fragmentary bottom plan view thereof;

DESCRIPTION OF THE PREFERRED EMBODIMENT

Figure 3:
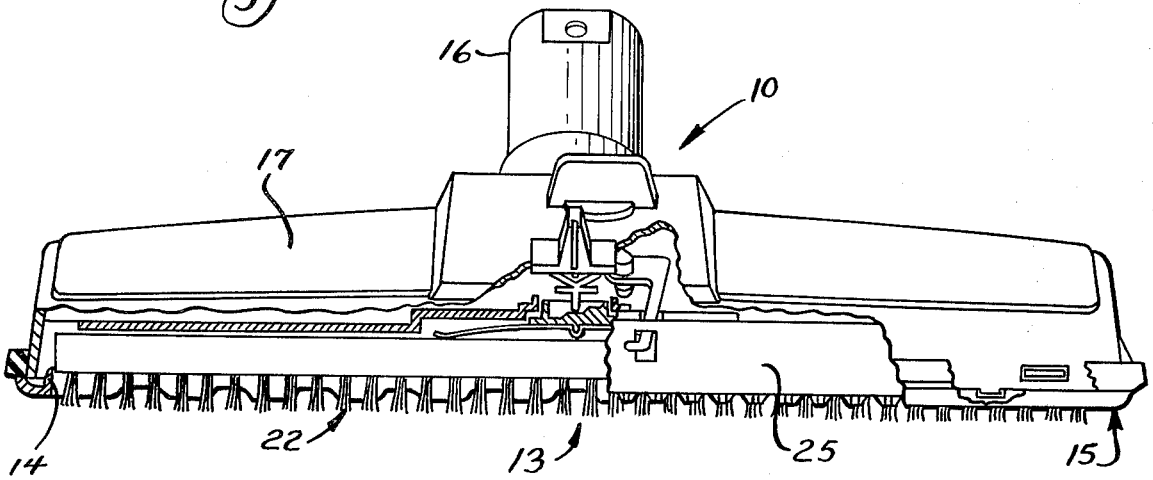
FIG. 3 is a front elevation thereof with portions broken away to illustrate the tool construction.

In the exemplary embodiment of the invention as disclosed in FIGS. 1 and 2, a vacuum cleaner suction tool generally designated 10 is shown to comprise a nozzle 11 defining a suction inlet opening 12 including a mid-portion 13 and opposite end or edge portions 14 and 15. The nozzle further defines an outlet tube 16 adapted to have tubular wand connected thereto for conducting dirt laden air delivered through the nozzle to a dirt collecting means (not shown) of conventional construction.

Figure 4:
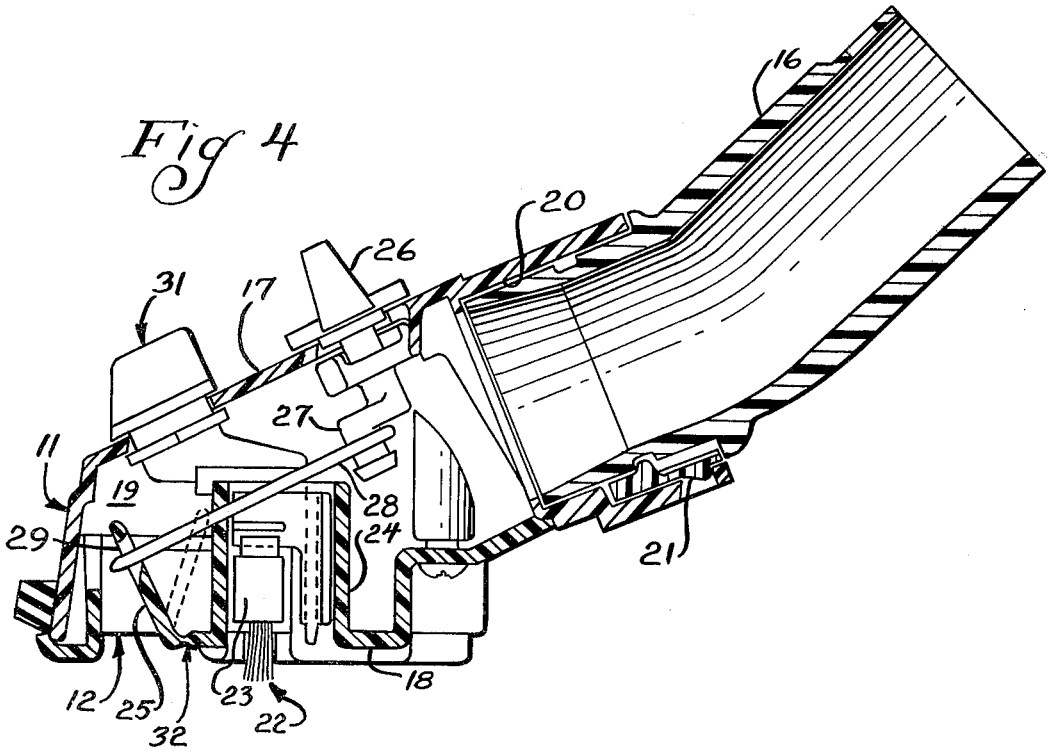
FIG. 4 is a fragmentary enlarged vertical section taken substantially along the line 4—4 of FIG. 1.

As best seen in FIG. 4, the nozzle includes a top wall 17 and a bottom wall 18 cooperatively defining a flow passage 19 for conducting the dirt laden air drawn through the suction inlet opening 12 to the outlet 16. The nozzle defines an outlet opening 20 to which the outlet tube 16 is secured by suitable releasable latching means 21.

To facilitate loosening of the dirt, a brush 22 may be provided extending rearwardly adjacent the suction inlet opening 12. The brush may include a brush carrying portion 23 retained in a receptacle portion 24 of the nozzle bottom wall 18.

As indicated briefly above, the present invention comprehends the provision in such a suction tool of means for controlling the air flow through the inlet opening 12 so as to selectively permit the entire inlet opening to conduct the air into the nozzle, or only the end portions of the inlet opening to conduct the air through the nozzle. Thus, as shown in FIGS. 2–4, the bottom wall 18 effectively defines an integral valve, or air flow blocking means 25 which extends across the mid-portion 13 of the inlet opening 12 but which terminates at the end portions 14 and 15 thereof so that end portions 14 and 15 are open at all times with mid-portion 13 being selectively open or closed as desired by the user.

To effect such controlled disposition of the blocking means 25, a control knob 26 is rotatably mounted to the top wall 17 of the nozzle and is connected through a connecting portion 27 and link 28 to the blocking means 25 as shown in FIG. 4. Connecting portion 27 defines an arm extending radially from the axis of rotation of handle 26 so that rotation of the handle effectively longitudinally moves the link 28 to swing the air blocking means 25 between the full line position of FIG. 4 and the dotted line position thereof corresponding respectively to the obstructing and nonobstructing arrangements of the blocking means relative to the mid-portion 13 of the inlet. As shown in FIG. 1, the knob 26 is disposed to indicate, in combination with suitable indicia 30, the disposition of the blocking means so as to provide the suction selectively only at the ends of the nozzle or in the normal manner through the entire nozzle inlet opening. As further shown in FIG. 1, a second manual control 31 is disposed adjacent knob 26 for manually controlling the arrangement of the nozzle for use with different pile height carpeting, both manual controls being disposed in the mid-portion of the nozzle, as shown.

As shown in FIG. 4, the air blocking means or valve 25 may be formed integrally with the bottom wall 18 and may be connected thereto by an integral hinge 32 for facilitated low cost construction. Thus, the bottom wall, including the blocking element 25, may comprise a molded element formed of conventional synthetic resin material suitable to define the hinge 32.

As discussed above, air may flow upwardly through the end portions 14 and 15 of the inlet opening 12 when the air blocking means or valve 25 is shown in the blocking position substantially closing the mid-portion 13 of the inlet opening. The air flows from the end portions 14 and 15 over the blocking means 25 and thence outwardly to the outlet opening 20 and outlet tube 16, with substantially the entire suction force developed by the vacuum cleaner air moving means acting to draw the air through these limited size end openings whereby an improved, highly efficient vacuum suction action is obtained at the end of the nozzle which may be disposed readily immediately adjacent the upstanding wall, or other vertical obstruction, alongside the surface to be cleaned.

The suction tool of the present invention is extremely simple and economical of construction and the selective operation of the air flow control may be readily effected in the desired use of the vacuum cleaner.

The foregoing disclosure of specific embodiments is illustrative of the broad inventive concepts comprehended by the invention.

Having described the invention, the embodiments of the invention in which an exclusive property or privilege is claimed are defined as follows:

1. A vacuum cleaner suction tool comprising: a nozzle defining a suction inlet opening including a midportion and an edge portion, a suction outlet opening, and a flow passage for conducting dirt laden air drawn through said suction inlet opening mid-portion and edge portion to said outlet opening; and blocking means for selectively substantially blocking air flow through said suction inlet opening mid-portion to provide high suction force at said suction inlet edge portion, said blocking means being incapable of restricting air flow through said suction inlet edge portion.

2. The vacuum cleaner suction tool of Claim 1 wherein a plurality of such edge portions of the suction inlet opening are provided.

3. The vacuum cleaner suction tool of Claim 1 wherein said suction inlet opening is elongated and a pair of such edge portions is provided one each at the ends of said opening.

4. The vacuum cleaner suction tool of claim 1 wherein means are provided for adjusting the nozzle height for use with different pile height carpeting including an adjusting control member disposed at a portion of said nozzle, and said means for selectively blocking a flow includes an adjusting control member disposed adjacent said pile height adjusting control member.

5. The vacuum cleaner suction tool of Claim 1 wherein said means for selectively blocking air flow comprises a flap-type valve and manually operable means for swinging said valve between flow-blocking and flow-passing positions across said mid-portion of the suction inlet.

6. The vacuum cleaner suction tool of claim 1 wherein said means for selectively blocking air flow comprises a flap-type valve member formed of synthetic resin, a base portion, and an integral hinge connection between said valve member and said base portion.

7. The vacuum cleaner suction tool of claim 1 wherein said nozzle defines an elongated hollow member having opposite ends, and said edge portion of the suction inlet opening comprises a portion thereof at an end of said nozzle.

8. The vacuum cleaner suction tool of claim 1 wherein said blocking means includes a blocking means movable between a first position and a second position, said blocking means blocking said mid-portion air flow in said first position and causing said mid-portion to be substantially unrestricted in said second position.

9. A vacuum cleaner suction tool comprising: a nozzle defining an upwardly facing top wall, a suction inlet opening adjacent said wall including a mid-portion and an edge portion, a suction outlet opening, and a flow passage for conducting dirt laden air drawn through said suction inlet opening mid-portion and edge portion to said outlet opening; and blocking means for slectively blocking air flow through said suction inlet opening mid-portion to provide selectively high suction force at said suction inlet edge portion or causing said mid-portion to be substantially unrestricted, said blocking means including valve means for selectively blocking air flow including an adjusting control member defining a manipulating portion overlying said top wall, said valve means being incapable of restricting air flow through said suction inlet edge portion.

10. A vacuum cleaner suction tool comprising: a nozzle defining an upwardly facing top wall, a suction inlet opening adjacent said wall including a mid-portion and an edge portion a suction outlet opening, and a flow passage for conducting dirt laden air drawn through said suction inlet opening mid-portion and edge portion to said outlet opening; and blocking means for selectively blocking air flow through said suction inlet opening midportion to provide selectively high suction force at said suction inlet edge portion or causing said mid-portion to be substantially unrestricted, said blocking means including valve means for selectively blocking air flow including an adjusting control member defining a manipulating portion overlying said top wall, said blocking means including a mounting portion and a valve integral with said mounting portion, said mounting portion further defining a brush carrying portion.

11. A vacuum cleaner suction tool comprising: a nozzle defining an upwardly facing top wall, a suction inlet opening adjacent said wall including a mid-portion and an edge portion, a suction outlet opening, and a flow passage for conducting dirt laden air drawn through said suction inlet opening mid-portion and edge portion to said outlet opening; and blocking means for selectively blocking air flow through said suction inlet opening midportion to provide selectively high suction force at said suction inlet edge portion or causing said mid-portion to be substantially unrestricted, said blocking means including valve means for selectively blocking air flow including an adjusting control member defining a manipulating portion overlying said top wall, said blocking means including a mounting protion and a valve integral with said mounting portion, said mounting portion further defining a brush carrying portion disposed rearwardly of said valve.

12. The vacuum cleaner suction tool of claim 9 wherein said flow passage means includes means for conducting dirt laden air to the center of said nozzle and thence to said outlet opening.

13. The vacuum cleaner suction tool of claim 9 further including means for adjusting the nozzle height for use with different pile height carpeting including an adjusting control member disposed adjacent said air flow blocking means adjusting control member.

* * * * *